US010389060B2

(12) United States Patent
Diessel et al.

(10) Patent No.: US 10,389,060 B2
(45) Date of Patent: Aug. 20, 2019

(54) ASSEMBLY OF A PLUG CONNECTOR PART COMPRISING A HOLDER FRAME FOR RECEIVING MODULAR CONTACT INSERTS

(71) Applicant: PHOENIX CONTACT GMBH & CO. KG, Blomberg (DE)

(72) Inventors: Thorsten Diessel, Hiddenhausen (DE); Dennis Sprenger, Horn-Bad Meinberg (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 15/770,756

(22) PCT Filed: Oct. 26, 2016

(86) PCT No.: PCT/EP2016/075711
§ 371 (c)(1),
(2) Date: Apr. 25, 2018

(87) PCT Pub. No.: WO2017/072132
PCT Pub. Date: May 4, 2017

(65) Prior Publication Data

US 2018/0309227 A1 Oct. 25, 2018

(30) Foreign Application Priority Data

Oct. 27, 2015 (DE) ..... 10 2015 118 263

(51) Int. Cl.
*H01R 13/60* (2006.01)
*H01R 13/518* (2006.01)
(Continued)

(52) U.S. Cl.
CPC ..... *H01R 13/518* (2013.01); *H01R 13/512* (2013.01); *H01R 13/514* (2013.01); *H01R 13/6275* (2013.01); *H01R 13/73* (2013.01)

(58) Field of Classification Search
CPC .. H01R 13/518; H01R 13/512; H01R 13/514; H01R 13/6275; H01R 13/73
(Continued)

(56) References Cited

U.S. PATENT DOCUMENTS 5,125,854 A * 6/1992 Bassler ..... H01R 13/648 439/607.27
6,142,799 A 11/2000 Marcel
(Continued)

FOREIGN PATENT DOCUMENTS

DE 29514607 U1 11/1995
DE 202005007221 U1 9/2006
(Continued)

*Primary Examiner* — Khiem M Nguyen
(74) *Attorney, Agent, or Firm* — Leydig, Voit & Mayer, Ltd.

(57) ABSTRACT

An assembly of a plug-in connector part includes: a holder frame for receiving at least one modular contact insert, the holder frame enclosing an opening into which at least one contact insert can be inserted; and a housing part having a receiving opening into which the holder frame is inserted in an insertion direction, and a bearing portion on which the holder frame rests in a position in which the holder frame is inserted into the receiving opening. The housing part includes a locking opening and the holder frame includes a locking unit for locking the holder frame to the housing part in the inserted position. The locking unit includes a locking element which, in a locked position, form-fittingly engages in the locking opening in the housing part.

16 Claims, 13 Drawing Sheets

(51) Int. Cl.

| | |
|---|---|
| ***H01R 13/73*** | (2006.01) |
| ***H01R 13/512*** | (2006.01) |
| ***H01R 13/627*** | (2006.01) |
| ***H01R 13/514*** | (2006.01) |

(58) Field of Classification Search
USPC ..... 439/94, 95, 540.1, 705
See application file for complete search history.

(56) References Cited

U.S. PATENT DOCUMENTS

| | | | | |
|---|---|---|---|---|
| 7,901,221 | B1 * | 3/2011 | Li | H01R 13/6582 439/95 |
| 8,317,544 | B2 * | 11/2012 | Matsuoka | H01R 4/64 439/607.55 |
| 8,636,545 | B2 * | 1/2014 | Chow | H01R 13/514 439/607.27 |
| 2016/0276778 | A1 | 9/2016 | Beischer et al. | |

FOREIGN PATENT DOCUMENTS

| | | | |
|---|---|---|---|
| DE | 202012103360 | U1 | 1/2013 |
| DE | 102012110907 | A1 | 5/2014 |
| EP | 0999610 | A2 | 5/2000 |
| EP | 2648289 | A1 | 10/2013 |
| FR | 2148699 | A5 | 3/1973 |
| GB | 1394867 | A | 5/1975 |
| JP | 2005293996 | A | 10/2005 |

* cited by examiner

ASSEMBLY OF A PLUG CONNECTOR PART COMPRISING A HOLDER FRAME FOR RECEIVING MODULAR CONTACT INSERTS

CROSS-REFERENCE TO PRIOR APPLICATIONS

This application is a U.S. National Phase application under 35 U.S.C. § 371 of International Application No. PCT/EP2016/075711, filed on Oct. 26, 2016, and claims benefit to German Patent Application No. DE 10 2015 118 263.7, filed on Oct. 27, 2015. The International Application was published in German on May 4, 2017 as WO 2017/072132 under PCT Article 21(2).

FIELD

The invention relates to an assembly of a plug-in connector part having a holder frame and a housing part.

BACKGROUND

An assembly of this kind includes a holder frame for receiving at least one modular contact insert. For this purpose, the holder frame encloses an opening into which at least one contact insert can be inserted. A housing part comprises a receiving opening into which the holder frame can be inserted in an insertion direction, and a bearing portion on which the holder frame rests in a position in which said frame is inserted into the receiving opening.

Holder frames of this kind are suitable for the modular use of contact inserts on plug-in connector parts. One or more contact inserts may be arranged on a holder frame of this kind in order to be inserted into a housing of a plug-in connector part, together with the holder frame, and to be connected to the housing. In this way, contact inserts can be combined in a modular manner and can be arranged in or on a plug-in connector part by means of the holder frame.

Contact inserts of this kind may comprise for example one or more electrical contacts. In this case, the contact inserts are connected to electrical lines supplied to a plug-in connector, and form plug-in contacts by means of which the plug-in connector can be brought into a plug-in engagement with a mating plug-in connector part in order to provide electrical contacting therewith.

Modular contact inserts of this kind offer the advantage of flexible combinability, thus allowing plug-in connectors to be used in various ways.

A holder frame known from DE 10 2012 110 907 A1 provides for a second holder frame element to be placed onto a first holder frame element that comprises recesses for receiving projection elements of contact inserts, in order to thus block projection elements positioned in the recesses and therefore lock said elements in place on the holder frame.

In the case of a holder frame known from DE 20 2012 103 360 U1, two kinds of recesses are provided in frame walls. Projection elements of contact inserts can be inserted so as to engage in first recesses in an upper edge of the frame walls, whereas pin-like formations on the contact inserts can be brought into latching engagement with second recesses in the form of openings.

In the case of a fastening insert known from DE 20 2005 007 221 U 1 for a plug-in connector, a mounting frame on which a contact insert is arranged can be inserted into a receiving opening in a device housing in order to be fixed therein. The mounting frame consists, at least in part, of an electrically conductive material in order to provide an electrically conductive connection between the contact insert and the device housing. In an inserted position, the mounting frame is latched onto the device housing by means of a plurality of latching elements.

Conventionally, a holder frame for receiving modular contact inserts is often screwed to a housing part into which the holder frame is to be inserted. Although this ensures a mechanically rigid, reliably sustainable connection, this requires, however, a comparatively complex mounting process, since, in order to connect the holder frame to an associated housing part of the holder frame, the holder frame is initially inserted into the housing part and then screwed into the housing part by applying screw connections.

SUMMARY

In an embodiment, the present invention provides an assembly of a plug-in connector part, comprising: a holder frame configured to receive at least one modular contact insert, the holder frame enclosing an opening into which at least one contact insert can be inserted; and a housing part comprising a receiving opening into which the holder frame is configured to be inserted in an insertion direction, and a bearing portion on which the holder frame rests in a position in which the holder frame is inserted into the receiving opening, wherein the housing part comprises a locking opening and the holder frame comprises a locking unit configured to lock the holder frame to the housing part in the inserted position, the locking unit comprising a locking element which, in a locked position, is configured to form-fittingly engage in the locking opening in the housing part.

BRIEF DESCRIPTION OF THE DRAWINGS

The present invention will be described in even greater detail below based on the exemplary figures. The invention is not limited to the exemplary embodiments. Other features and advantages of various embodiments of the present invention will become apparent by reading the following detailed description with reference to the attached drawings which illustrate the following.

DETAILED DESCRIPTION

Figure 1:
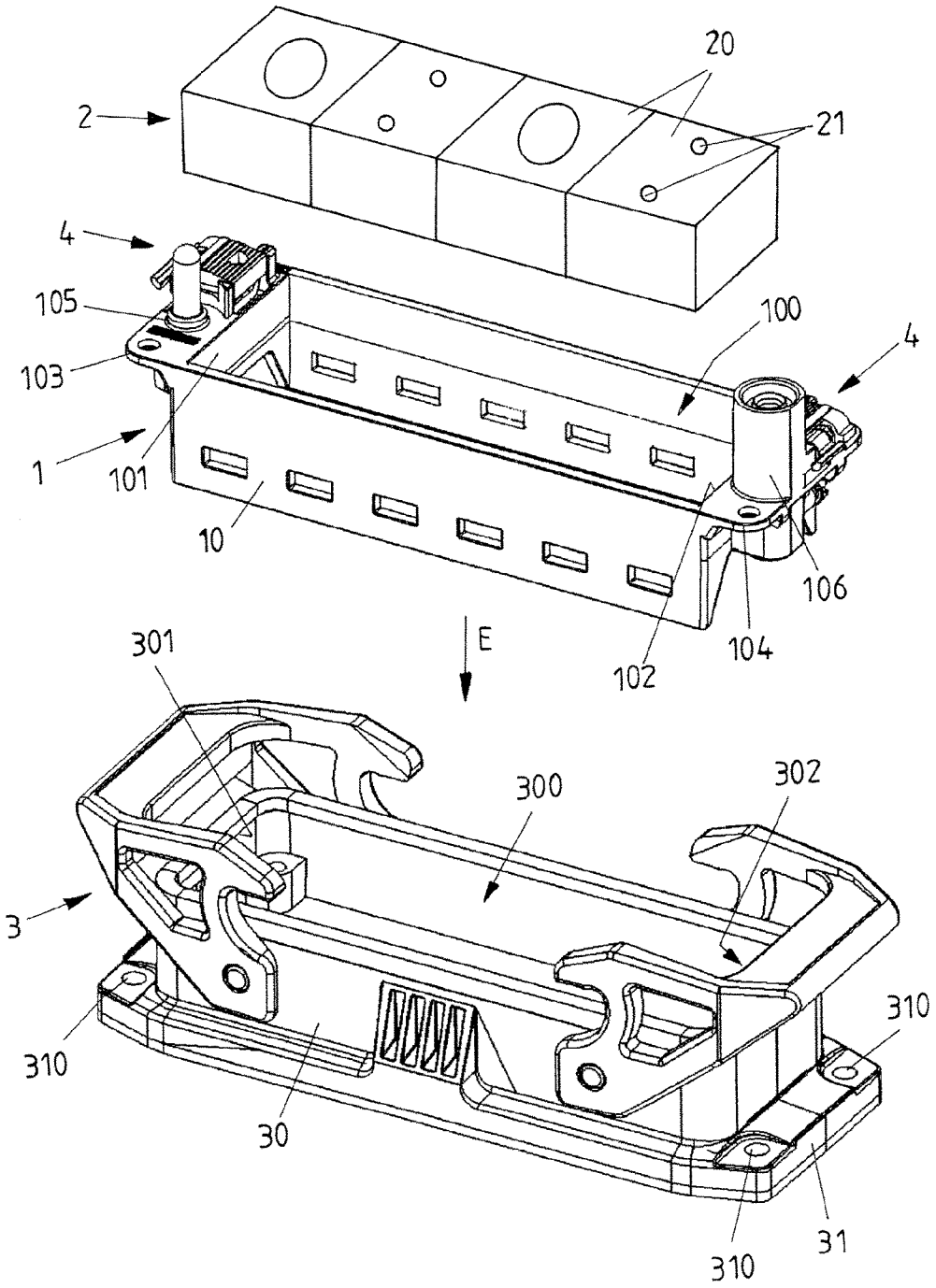
FIG. 1 shows a holder frame and a housing part of a plug-in connector part.

In an embodiment, the present invention provides an assembly of a plug-in connector part in which the connection of a holder frame to a housing part can be simplified.

Accordingly, the housing part comprises a locking opening and the holder frame comprises a locking unit for locking the holder frame to the housing part in the inserted position. The locking unit comprises a locking element which, in a locked position, form-fittingly engages in the locking opening in the housing part.

When the holder frame is inserted into the receiving opening in the housing part, a form-fitting connection is produced between the holder frame and the housing part by means of the locking unit of the holder frame. In this regard, the locking unit can be designed such that, when the holder frame is inserted into the receiving opening in the housing part, the locking between the holder frame and the housing part occurs automatically by the locking element of the locking unit on the holder frame form-fittingly snapping into engagement with the locking opening in the housing part. In order to lock the holder frame to the housing part, it is also conceivable and possible, however, for the locking element to be brought into engagement with the locking opening by a user, for example using a suitable tool or manually using a finger; the locking is thus intended to be carried out manually by a user in a separate step.

Because the locking element, in the locked position, form-fittingly engages in the locking opening provided in the housing part, a secure, reliable connection is produced between the holder frame and the housing part, which connection can be readily detached by unlocking the locking unit. Providing screw connections when the holder frame is inserted into the receiving opening in the housing part can thus be omitted, and therefore the connection between the holder frame and the housing part is produced in a simple manner.

In order to connect the holder frame to the housing part, the holder frame is inserted into the receiving opening in the housing part in the insertion direction such that for example lateral flange portions of the holder frame come to abut one or more bearing portions in on the housing part. In the inserted position, the holder frame therefore rests on the one or more bearing portions such that the holder frame—when viewed axially in the insertion direction—is in a defined position inside the housing part.

In this regard, for the holder frame to be securely held, without play, inside the housing part, the locking element can exert a clamping force on the holder frame in the insertion direction by engaging in the locking opening in the housing part in the locked position. This results in the holder frame being pressed into abutment with the bearing portion in the insertion direction, meaning that the holder frame abuts the bearing portion under preloading, and is thus locked in place against the bearing portion without play.

The locking element is therefore designed such that a clamping force is exerted on the holder frame in the insertion direction. If the locking is provided between the holder frame and the housing part, the holder frame is therefore positioned in the housing part under preloading.

In this way, reliable electrical contacting can also be effected between the holder frame and the housing part in the inserted position. In order for the holder frame to electrically contact the housing part, the holder frame and the housing part are each made from an electrically conductive, metal material, for example. On account of the abutment with the bearing portion, the holder frame is thus electrically contacted to the housing part, meaning that the holder frame and the housing part are at the same ground potential (known as PE contacting).

The holder frame and the housing part may be produced as zinc die-cast parts or as aluminum die-cast parts, for example, and are thus electrically conductive. Alternatively, it is possible for the holder frame and/or the housing part to be produced as plastics parts, for example as injection-molded plastics parts, it being possible in this case for electrically conductive portions, for example in the form of contacting metal sheets or similar, to be provided in or on the holder frame or housing part.

Because a clamping force is exerted on the holder frame in the insertion direction by means of the locking unit when the locking is provided between the holder frame and the housing part, and the holder frame is thus pressed into abutment with the bearing portion of the housing part in the insertion direction, advantageous electrical contacting can be provided between the holder frame and the bearing portion of the housing part. The clamping force results in reliable contacting, whilst minimizing electrical transition resistance.

For example, the holder frame, in the inserted position, can rest on the bearing portion by means of a laterally projecting flange portion. In a specific embodiment, flange portions are provided either side of the holder frame, each of which portions rests on one or more bearing portions inside the receiving opening in the housing part when the holder frame is inserted into the receiving opening in the housing part.

An associated mating plug-in connector part can for example be placed onto the plug-in connector part, of which the holder frame inserted into the receiving opening in the housing part is a component, in order to electrically contact for example electrical contacts of the modular contact inserts arranged on the holder frame. In this regard, a contact element can be arranged on the flange portion of the holder frame, which element electrically contacts a mating contact element of the mating plug-in connector part when the mating plug-in connector part is placed onto the plug-in connector part associated with the holder frame, and therefore for example PE contacting is provided between the holder frame and the mating plug-in connector part.

The locking between the holder frame and the housing part is preferably detachable. If the holder frame is inserted into the receiving opening in the housing part, the locking is produced and the holder frame is thus locked to the housing part. In turn, in order to withdraw the holder frame from the housing part, the locking can be detached such that the holder frame can be withdrawn from the receiving opening in the housing part counter to the insertion direction.

For actuation, the locking element may for example be connected to an actuating element and can be shifted between an unlocked position and the locked position by means of the actuating element. The actuating element may be designed for example as a separate element that is connected to the locking element in an appropriate manner (for example form-fittingly). It is, however, also conceivable and possible for the actuating element and the locking element to be designed in one piece as an integral component, and to thus constitute different portions of the same component.

For simple actuation, the actuating element may for example comprise an engagement opening into which a tool, for example a screwdriver, can be inserted in order to move the actuating element and to thus shift the locking element between the locked position and the unlocked position thereof.

The locking between the holder frame and the housing part can be provided for example by means of an edge of the locking element, which edge abuts an associated edge of the housing part counter to the insertion direction and thus blocks the holder frame relative to the housing part counter to the insertion direction. The edge can be designed for example to extend perpendicularly to the insertion direction on a locking portion of the locking element, and is positioned in the locking opening in the housing part when the locking element is in the locked position. Because the edge abuts an abutment edge that defines the locking opening counter to the insertion direction, withdrawing the holder frame from the housing part is blocked counter to the insertion direction, and the holder frame can also be pushed into the housing in the insertion direction under preloading.

The locking element of the locking unit can in principle have a completely different design.

In a first variant, the locking element is arranged on a frame part of the holder frame so as to be pivotable about a mounting pin extending perpendicularly to the insertion direction. For example, the locking element can be arranged about a mounting pin on a flange portion of the holder frame. By pivoting the locking element, the locking element can be shifted between the locked position and the unlocked position thereof, in order to thus lock the holder frame to the housing part, or to detach the locking in order to be able to withdraw the holder frame from the housing part.

In this regard, in order to secure the locking element in the locked position thereof and thus provide reliable locking between the holder frame and the housing part, a latching portion, for example in the form of a latching lug, may be arranged on the housing part, associated with the locking element, of the holder frame, with which latching portion the locking element latches when in the locked position thereof. In this way, the locking element, when in the locked position, is form-fittingly held in the locked position such that the locking between the holder frame and the housing part cannot readily be removed, at least not without removing the latching between the locking element and the latching portion on the holder frame.

The locking element, just as with the actuating element, can be produced in the embodiments as metal parts, in particular die-cast metal parts. It is also conceivable and possible, however, for the locking element and/or the actuating element to be produced as plastics parts.

In a second variant, the locking element is integral with a frame part of the holder frame. The engagement element is thus integral with the frame part and can be produced as a resilient tab on the frame part, for example. In this case, the holder frame is for example produced as a plastics frame, and accordingly the plastics locking element is integrally connected to the holder frame.

In a third variant, the locking element may be for example integral with a contacting element arranged on a frame part of the holder frame for electrically contacting the bearing portion of the housing part, or said locking element may be placed onto the contacting element and thus connected to the contacting element. The contacting element may for example be produced as a piece of sheet metal and, accordingly, the locking element may be produced as a sheet metal tab projecting from the contacting element. This variant is applicable for example if the holder frame is produced from plastics material and thus an additional contacting element, for example in the form of a contacting metal sheet, is used for electrically contacting the housing part.

In a fourth variant, the locking element is designed as a wire spring. In this case, the locking element designed as a wire spring may for example be held on a contacting element arranged on a frame part of the holder frame, which element is for example in the form of a contacting metal sheet, for electrically contacting the bearing portion of the housing part. The wire spring may for example be fixed so as to be clamped between the contacting element and the frame part of the holder frame, the wire spring being resilient such that, when the holder frame is inserted into the receiving opening in the housing part, the wire spring can be resiliently brought into form-fitting engagement with the locking opening in the housing part or automatically snaps into engagement therewith and, for unlocking, can be removed from the engagement position in order to be able to withdraw the holder frame from the housing part.

In a fifth variant, the locking element can be rotated about an axis of rotation that is oriented longitudinally in the insertion direction. In order to lock the holder frame to the housing part, the locking element can be rotated from the unlocked position into the locked position thereof and engages, in the locked position, in the locking opening in the housing part by means of a locking portion such that the locking is provided between the holder frame and the housing part.

In a sixth variant, the locking between the holder frame and the housing part is provided by clamping the locking element to the housing part. In this case, the locking element is designed for example as a bracket that is movably arranged on a frame part of the holder frame, engages with a clamping element, for example in the form of a screw, and can be clamped with respect to the frame part by means of the clamping element such that the locking element, in the locked position, is positioned in the locking opening in the housing part under preloading. In an unlocked position, the bracket-shaped locking element is in a relaxed position on the associated frame part, for example the flange portion of the holder frame, such that the holder frame can be readily inserted into the receiving opening in the housing part. In order to lock the holder frame to the housing part, the locking element is clamped with respect to the frame part by the clamping element being shifted. This results in the locking element form-fittingly engaging with the locking opening in the housing part such that the holder frame is locked with respect to the housing part.

The clamping element may be designed for example as a screw which is in threaded engagement with a threaded opening in the locking element. In this case, the screw can be supported at one end to a frame part of the holder frame such that, by screwing the screw into the threaded opening, the bracket-shaped locking element can be clamped with respect to the frame part.

By clamping the bracket-shaped locking element, the locking element can for example be removed from the associated frame part of the locking element, counter to the insertion direction, such that the locking element comes to abut the housing part in order to press the holder frame into abutment with the housing part in the insertion direction. On account of the clamping, the holder frame is therefore pressed into abutment with the bearing portion such that, thereabove, the position of the holder frame in the receiving opening in the housing part is secured and also, optionally, reliable electrical contacting is provided between the holder frame and the housing part.

The basic concept of the invention is intended to be described in more detail below with reference to the embodiments shown in the drawings, in which:

FIGS. 1 to 6A-6C show a first embodiment of an assembly of a plug-in connector part, comprising a holder frame 1 which can be inserted into a housing part 3 in an insertion direction E and is held in the housing part 3 in an inserted position.

The housing part 3, which can be formed for example as a metal part, for example as a zinc die-cast part or an aluminum die-cast part, comprises a receiving frame 30 and fastening portions 31 that project from the receiving frame 30 and comprise fastening points 310.

The housing part 3 can be secured to a housing 32, for example a device housing, by means of the fastening points 310 in order to thus provide a plug-in connector on the housing 32.

Modular contact inserts 2 (see FIG. 1) can be received in the holder frame 1 in order to secure the modular contact inserts 2 to the housing part 3 by means of the holder frame 1, in order to provide the plug-in connector part. The holder frame 1 comprises a frame 10 for receiving the modular contact inserts 2, which frame encloses a frame opening 100 into which the modular contact inserts 2 can be inserted.

The modular contact inserts 2 are provided modularly in the form of individual contact inserts 20, which can in principle be combined in any desired manner. Each of the contact inserts 20 can comprise for example one or more contacts 21 such that, by combining the contact inserts 20, a plug-in interface can be provided onto which an associated mating plug-in connector part can accordingly be placed in order to provide contacting.

In this regard, the mating plug-in connector part is placed on in the insertion direction E while, at the rear, connection lines that extend into the housing 32 can be connected to the contact inserts 20.

The contact elements 21 of the contact inserts 20 can provide electrical contacts, for example. It is also conceivable and possible, however, for the contact elements 21 to constitute other contacts, for example pneumatic contacts or the like.

In order to produce the plug-in connector part, the modular contact inserts 2 can be inserted into the frame opening 100 in the frame 10 of the holder frame 1. The holder frame 1 together with the modular contact inserts 2 received therein is then inserted into the housing part 3 in the insertion direction E such that the holder frame 1 abuts bearing portions 305 inside the receiving opening 300 by means of flange portions 103, 104 that project laterally from the frame 10 at end faces 101, 102 of the frame 10. In the inserted position (see for example FIG. 3), the holder frame 1 rests on the bearing portions 305 in the corners of the receiving opening 300 inside the receiving frame 30 by means of the flange portions 103, 104 such that the holder frame 1 assumes a defined position inside the housing part 3.

In the embodiment shown, the frame 10 of the holder frame 1 is preferably formed as a metal part, for example as a zinc die-cast part or as an aluminum die-cast part. The frame 10 is therefore electrically conductive. If the housing part 3 is also formed as a metal part, and is thus also electrically conductive, the holder frame 1 is brought into electrical contact with the housing part 3 when resting on the bearing portion 305 inside the receiving opening 300. If the housing part 3 is at ground potential, the holder frame 1 is therefore also at ground potential (known as PE contacting).

Contact elements 105, 106 are arranged on the flange portions 103, 104 of the holder frame 1 in the form of a contact pin 105 on the flange portion 103 and in the form of a contact socket 106 on the flange portion 104, which elements come into plug-in engagement with associated mating contact elements on the mating plug-in connector part when the mating plug-in connector part is plugged into the plug-in connector part formed by the holder frame 1 and the housing part 3, thus resulting in PE contacting with the mating plug-in connector part.

In order to lock the holder frame 1 to the housing part 3 in the position in which said frame is inserted into the receiving opening 300, a locking unit 4 is arranged on each flange portion 103, 104 of the holder frame 1 and is used, in the locked position, to provide form-fitting engagement with an associated locking opening 303, 104 in an end face 301, 302 of the receiving frame 30 of the housing part 3. In this case, the locking is such that the holder frame 1 is blocked with respect to the housing part 3 counter to the insertion direction E, and thus cannot readily be withdrawn from the housing part 3 counter to the insertion direction E, at least not without detaching the locking.

In the embodiment shown, the locking unit 4 comprises a locking element 41 and an actuating element 40, which are jointly pivotally mounted on a mounting pin 421 of a mounting means 42 on the associated flange portion 103, 104. In this case, the locking element 41 engages in a slot opening 404 in the actuating element 40 by means of a projection 405 such that the locking element 41 and the actuating element 40 are interconnected and the locking element 41 can thus be pivoted by means of the actuating element 40.

In the mounted position, the locking element 41 comes to abut a bearing portion 422 of the mounting means 42 by means of a mounting portion 412, and is mounted on the mounting pin 421 by means of the actuating element 40. The actuating element 40 comprises a mounting portion 402 having an opening 403 through which the mounting pin 421 engages such that the actuating element 40 and also the locking element 41 can be pivoted about the mounting pin 421.

The locking element 41 comprises a locking portion 411 having an edge 411A extending counter to the insertion direction E on a side facing the associated end face 301, 302 of the receiving frame 30 of the housing part 3. In the locked position (see FIGS. 3 and 4B), the locking element 41 engages, by means of said locking portion 411, in the associated locking opening 303, 304 in the housing part 3, resulting in the holder frame 1 being locked thereabove to the housing part 3.

Figure 2:
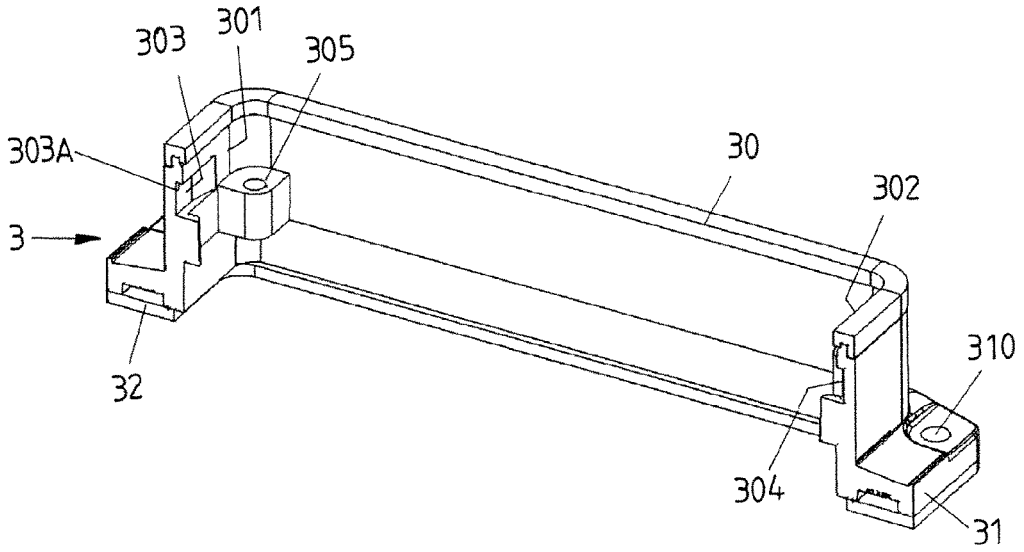
FIG. 2 is a sectional view of the housing part.
Figure 3:
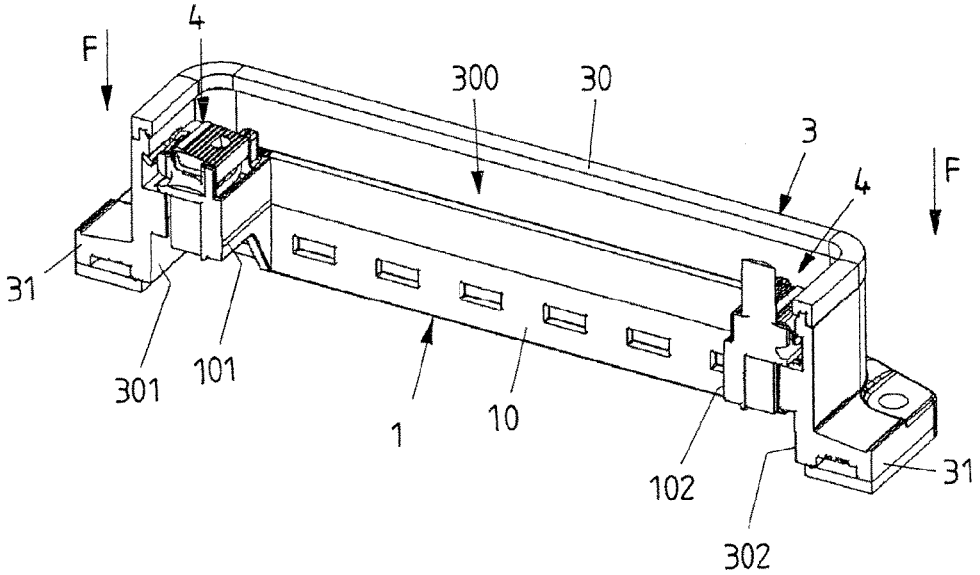
FIG. 3 is a sectional view of the housing part together with the holder frame placed thereon.
Figure 4A:
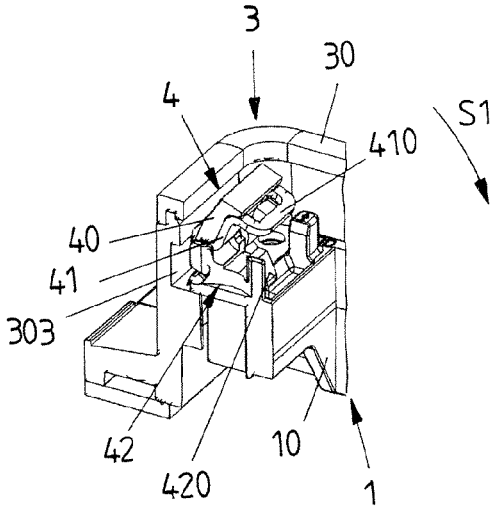
FIG. 4A shows an enlarged detail of a locking element of the holder frame, before locking.
Figure 4B:
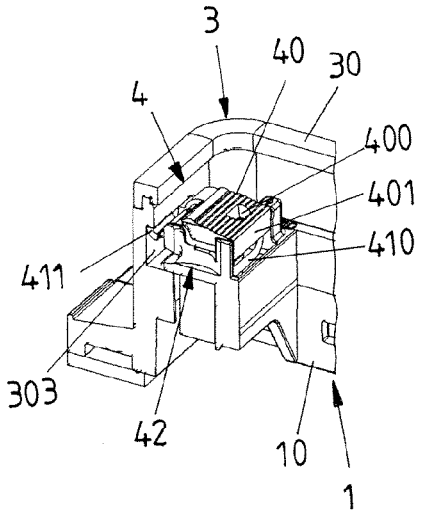
FIG. 4B is the view from FIG. 4A, with the locking element being locked.

In the locked position, in this case the edge 411A of the locking portion 411, which edge extends perpendicularly to the insertion direction E, abuts an abutment edge 303A that defines the locking opening 303, 304 counter to the insertion direction E, as can be seen in FIG. 2 in conjunction with FIG. 4B. The abutment takes place in this case under preloading, and therefore the locking element 41, which is for example formed as a piece of sheet metal and is thus elastically resilient, exerts a clamping force F on the holder frame 1 in the insertion direction E, as a result of which the holder frame 1 is pressed into abutment with the bearing portions 305 inside the receiving opening 300 in the housing part 3. On account of this preloaded abutment, the holder frame 1 is positioned inside the housing part 3 substantially without play. In addition, advantageous electrical contacting is provided between the holder frame 1 and the housing part 3 on account of the holder frame 1 abutting the bearing portions 305.

When the holder frame 1 is inserted into the housing part 3, the locking unit 4 are initially open, as shown in FIG. 4A. When the holder frame 1 is inserted into the receiving opening 300, the locking unit 4 are closed by a user pushing a handle 401 on the actuating element 40, for example using a finger, and pivoting the locking element 41 in a pivoting direction S1 and thus transitioning said element into the locked position shown in FIG. 4B. The locking portion 411, by means of the edge 411A, thus comes to abut the abutment edge 303A of the associated opening 303, 304 in the housing part 3, as a result of which the locking element 41 is clamped and thus exerts a clamping force F on the holder frame 1 in the insertion direction E.

In the locked position (FIG. 4B), the locking element 41 engages, by means of a latching hoop 410, in an undercut formed by a latching portion 420 in the form of a latching lug, such that the locking element 41 latches with the mounting means 42 in the locked position and is thus held in the locked position. The locked position of the locking element 41 is thus secured such that the locking element 41 cannot come out of its locked position without detaching the latching.

Figure 5A:
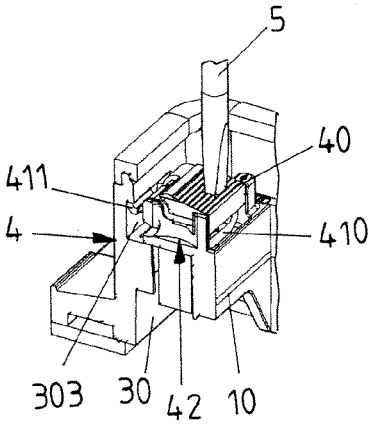
FIG. 5A is the view from FIG. 4B, with the locking element being unlocked.
Figure 5B:
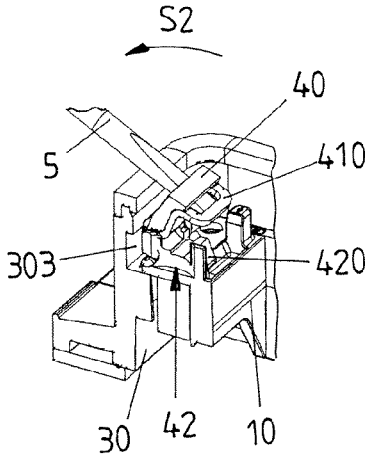
FIG. 5B is the view from FIG. 5A, with the locking element being unlocked.
Figure 6A:
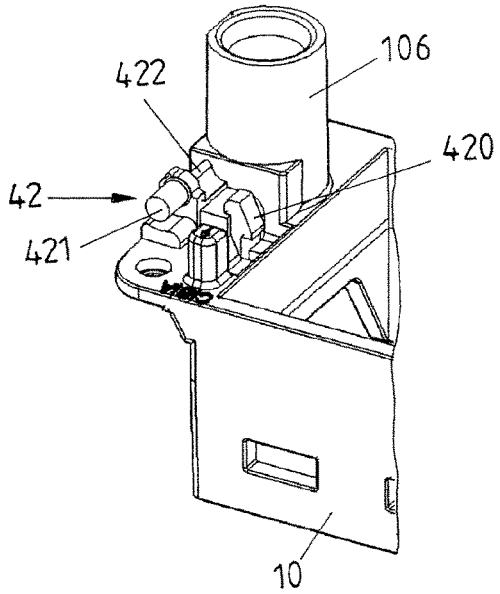
FIG. 6A is an enlarged view of a mounting region for pivotally mounting the locking element on the holder frame.
Figure 6B:
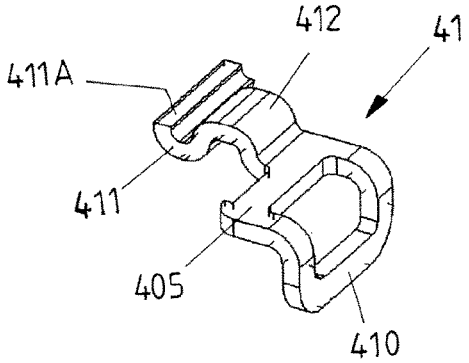
FIG. 6B is a separate view of the locking element.
Figure 6C:
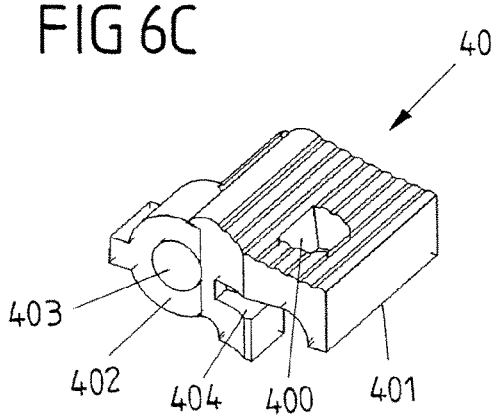
FIG. 6C is a separate view of an actuating element for actuating the locking element.

In order to detach the locking, a user can access an engagement opening 400 and engage the handle 401 on the actuating element 40 using a tool 5, for example in the form of a screwdriver, in order to thus detach the latching of the latching hoop 410 of the locking element 41 with the latching lug 420 of the mounting means 42 and to pivot the actuating element 40 together with the locking element 41 in a pivoting direction S2 that is counter to the pivoting direction S1 (see FIGS. 5A and 5B).

FIGS. 7A-7D and 8A-8C show a further embodiment of a locking unit 4. This embodiment is, as far as possible, functionally identical to the embodiment described above. The embodiments differ only in terms of the specific design of the mounting means 42, the locking element 41 and the actuating element 40.

In the embodiment shown in FIGS. 7A-7D and 8A-8C, both the locking element 41 and the actuating element 40 surround a mounting pin 421 of the mounting means 42, the locking element 41 being received on the actuating element 40 and the actuating element 40 being mounted on the mounting pin 421 by means of a mounting portion 402. The locking element 41 abuts a handle 401 on the actuating element 40 by means of an abutment portion 413 and comprises an edge 410 (obscured in FIG. 8B by the abutment portion 413) which, in the locked position of the locking element 41, latchingly engages with a latching portion 420 in the form of a latching lug of the mounting means 42 and, thereabove, the locking element 41 is locked in place in the locked position.

The locking element 41 comprises, on a side facing away from the abutment portion 413, a locking portion 411 having an edge 411A which, in the locked position, and analogously to as described for the embodiment above, lockingly engages with the associated locking opening 303, 304 in the housing part 3.

Figure 7A:
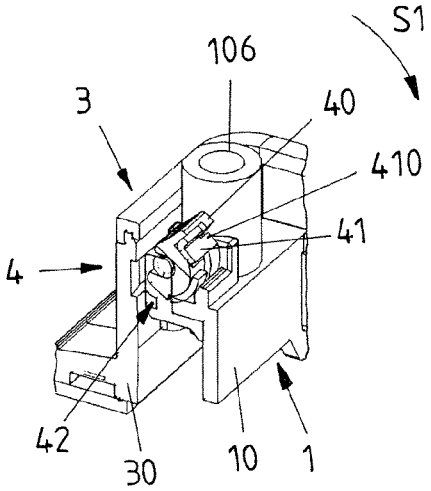
FIG. 7A shows a further embodiment of a locking unit of the holder frame, with a locking element being in an unlocked position.
Figure 7B:
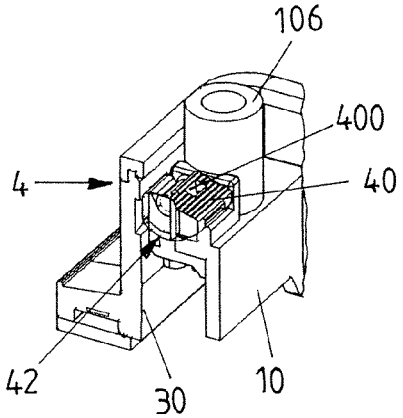
FIG. 7B is the view from FIG. 7A, with the locking element being locked.
Figure 7C:
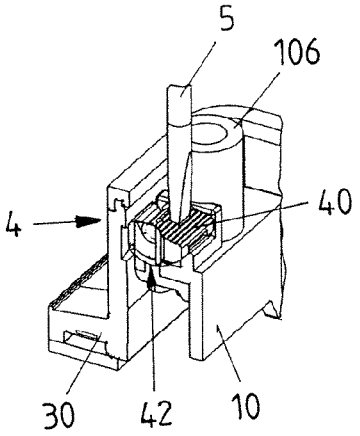
FIG. 7C is the view from FIG. 7B, with the locking element being unlocked.
Figure 7D:
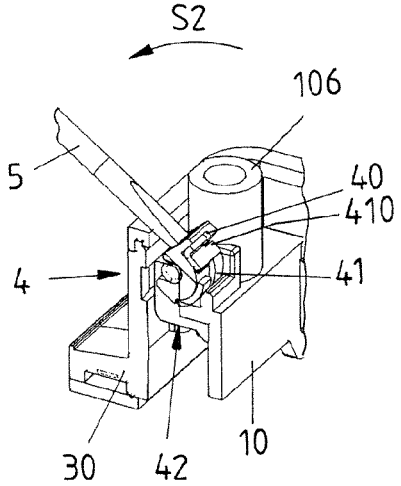
FIG. 7D is the view from FIG. 7C, with the locking element being unlocked.
Figure 8A:
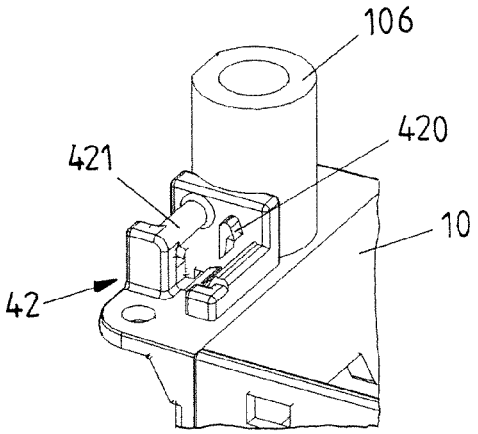
FIG. 8A is a separate view of a mounting region of the holder frame for pivotally mounting the locking element.
Figure 8B:
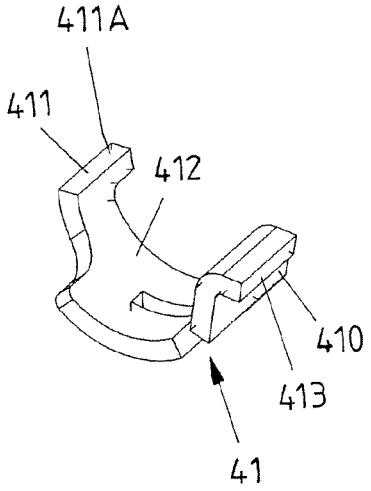
FIG. 8B is a separate view of the locking element.
Figure 8C:
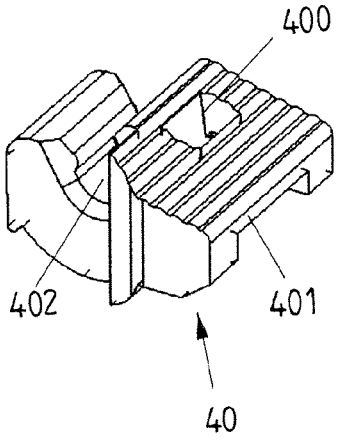
FIG. 8C is a separate view of an actuating element for actuating the locking element.

Analogously to as described above, the locking element 41 for locking the locking unit 4 can be pivoted in a pivoting direction S1 in order to thus provide a locking engagement with the associated locking opening 303, 304 in the housing part 3 (see FIGS. 7A and 7B). For unlocking, a user can access an engagement opening 400 and engage the handle 401 on the actuating element 40 using a tool 5, in order to thus act on the abutment portion 413 and to push the edge 410 out of engagement with the latching portion 420 such that the locking element 41, together with the actuating element 40, can be pivoted in an opposite pivoting direction S2 in order to detach the locking (see FIGS. 7C and 7D).

In the above embodiments, the holder frame 1 can preferably be produced as a metal part, and therefore the holder frame 1 electrically contacts the housing part 3 when said frame rests on the associated bearing portions 305 inside the receiving opening 300 in the housing part 3. However, this is not essential. It is also conceivable and possible, in the above-described embodiments, to form the holder frame 1 and/or the housing part 3 as plastics parts, it being possible in this case for example for suitable contacting parts in the form of metal strips or the like to be provided on the holder frame 1 and/or on the housing part 3 in order to provide electrical contacting between the holder frame 1 and the housing part 3.

Figure 9:
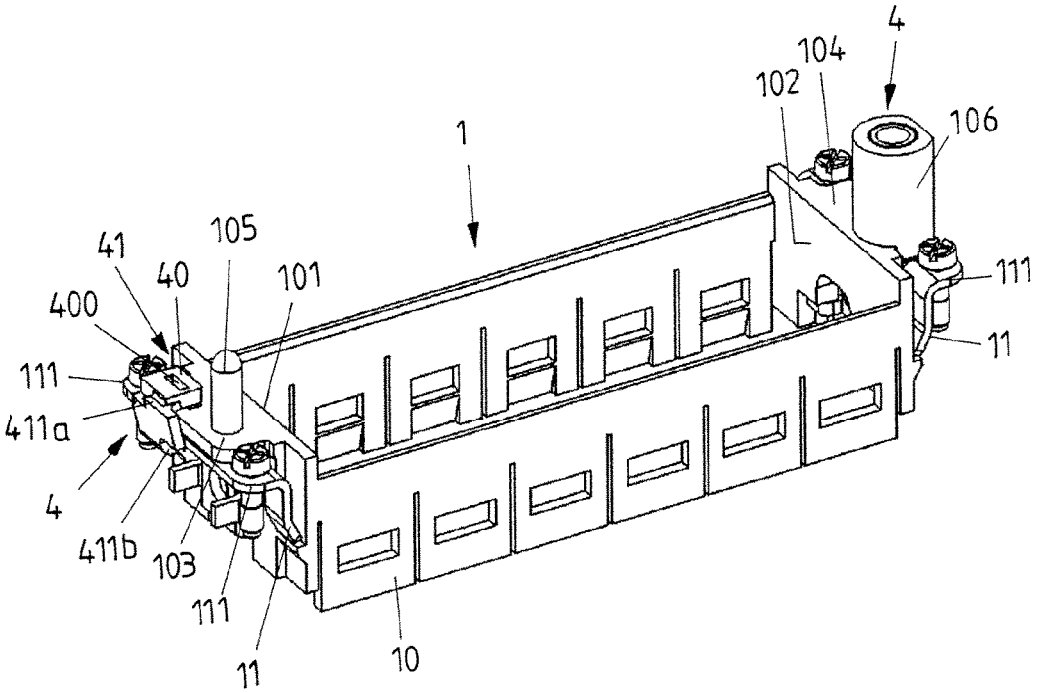
FIG. 9 shows a further embodiment of a holder frame, with a locking element that is integral with the holder frame

In an embodiment shown in FIG. 9, the holder frame 1 is formed as a plastics part and comprises a contacting element 11 at each end face 101, 102 of the frame 10, which element is used to electrically contact the housing part 3. In particular, when the holder frame 1 is inserted into the receiving opening 300 in the housing part 3, said frame comes to rest on the bearing portions 305 inside the receiving opening 300 by means of bearing portions 111 of the contacting elements 11, resulting in electrical contacting thereof.

In the view according to FIG. 9, screw elements are shown on the contacting elements 11, which screw elements can in principle be omitted, however, since the connection of the holder frame 1 to the housing part 3 is produced by means of locking unit 4 each having one locking element 41. In the embodiment shown, said locking element 41 is integral with the frame 10 of the holder frame 1. For example, the frame 10 can be produced in one piece together with the locking elements 41 as an injection-molded plastics part.

In the embodiment shown, each locking element 41 is integrally connected, by means of one end 411B of a locking portion 411, to the associated flange portion 103, 104 of the frame 10 of the holder frame 1. An edge 411A is formed on an end of the locking portion 411 that is remote from said end 411B, which edge, in the locked position of the locking element 41, lockingly engages with the associated locking opening 303, 304 in the housing part 3, analogously to as described for the above embodiments.

Adjoining said edge 411A is an actuating element 40 that is integrally connected to the locking element 41 and comprises an engagement opening 400 for allowing engagement by a tool. By means of the actuating element 40, the locking portion 411 can be drawn out of engagement with the associated locking opening 303, 304 in order, in this way, to unlock the holder frame 1 from the housing part 3 and thus to be able to withdraw said frame from the housing part 3.

The embodiment of the holder frame 1 shown is otherwise identical to the above-described embodiments, and therefore reference should also be made to the explanation above.

Figure 10A:
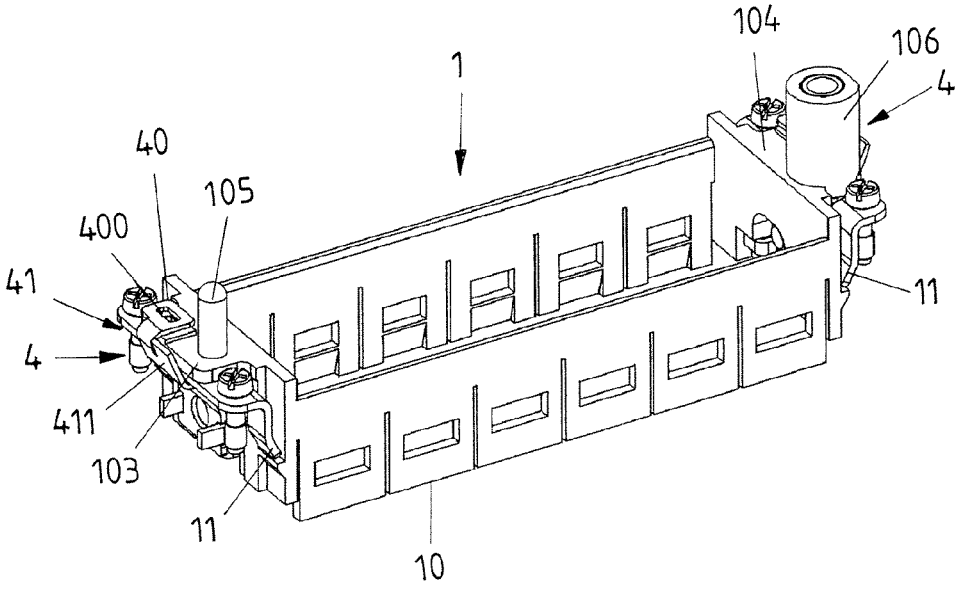
FIG. 10A shows a further embodiment of a holder frame, with a locking element arranged on a contacting element.
Figure 10B:
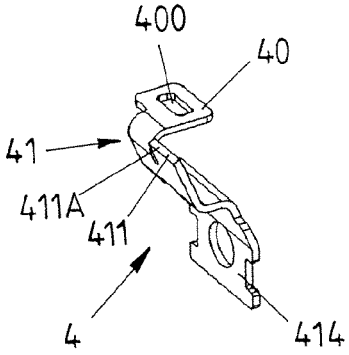
FIG. 10B is a separate view of the locking element.
Figure 10C:
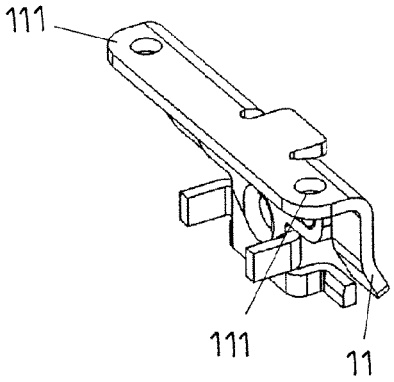
FIG. 10C is a separate view of the contacting element.

In a further embodiment, shown in FIG. 10A-10C, a locking element 41 is formed as a piece of sheet metal and is placed onto a contacting element 11 in the form of a contacting metal sheet. Analogously to the embodiment according to FIG. 9, the locking element 41 comprises an edge 411A used for locking and an actuating element 40 having an engagement opening 400, which element adjoins the locking portion 411. In the locked position, the locking portion 411 is positioned in the associated engagement opening 303, 304 in the housing part 3 by means of the edge 411A, and thus locks the holder frame 1 to the housing part 3. For unlocking, a user can access the engagement opening 400 in the actuating element 40 using a suitable tool in order to thus draw the locking portion 411 out of engagement with the associated locking opening 303, 304.

In the embodiment shown, the locking element 41 abuts the associated contacting element 11 by means of a connection portion 414, and is connected thereabove to the contacting element 11. For example, the locking element 41 can be form-fittingly or frictionally connected to, or integrally bonded with, the contacting element 11. For example, the locking element 41 can be screwed, welded or bonded to the contacting element 11.

Figure 11A:
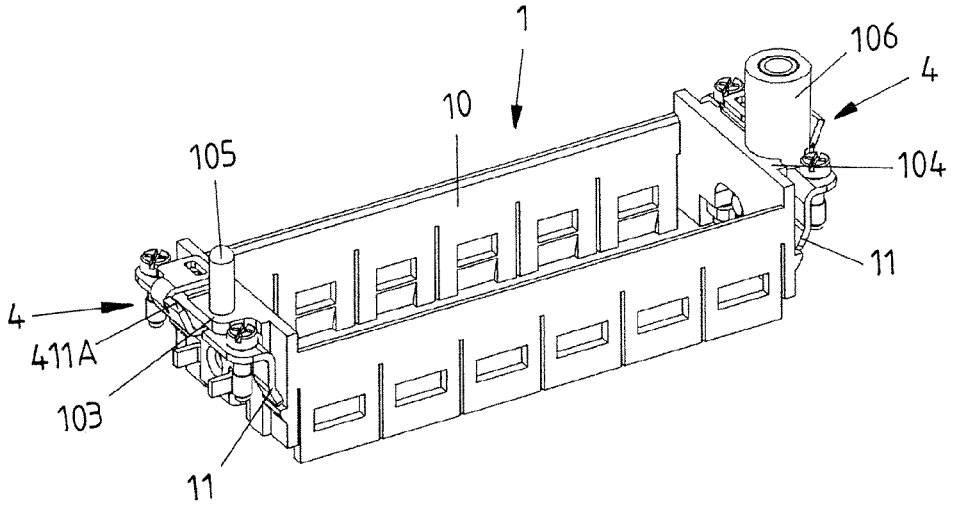
FIG. 11A shows a further embodiment of a holder frame, with a locking element that is integral with a contacting element.
Figure 11B:
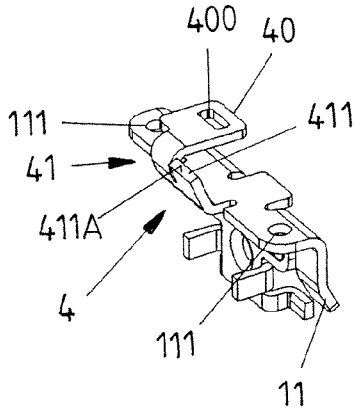
FIG. 11B is a separate view of the contacting element.

In an embodiment shown in FIG. 11A and 11B—with respect to the embodiment in FIGS. 10 to 10C—the locking element 41 is designed as a projecting tab that is integral with the contacting element 11 realized as a piece of sheet metal. The locking element 41 made of sheet metal is inherently elastically resilient and is otherwise identical in design to the embodiment according to FIG. 10A to FIG. 10C.

Figure 12A:
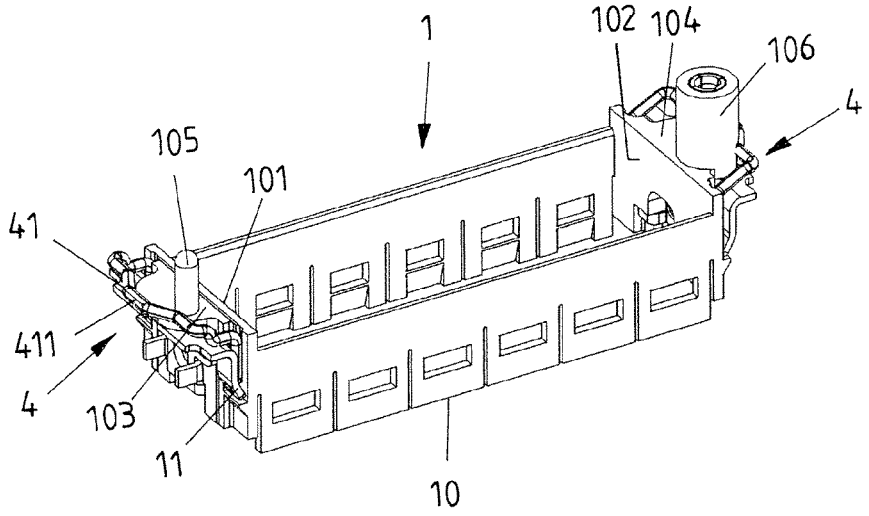
FIG. 12A shows a further embodiment of a holder frame, with a locking element in the form of a wire spring.
Figure 12B:
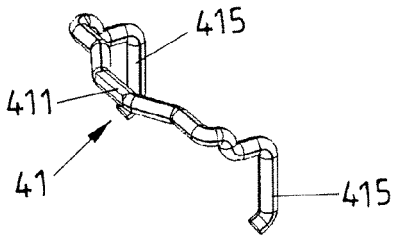
FIG. 12B is a separate view of the wire spring.
Figure 12C:
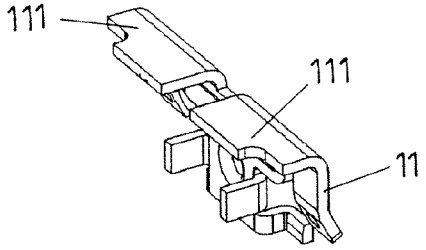
FIG. 12C is a separate view of a contacting element which is arranged on the holder frame.

In a further embodiment shown in FIG. 12A to 12C, the locking element 41 is designed as a wire spring and is held so as to be clamped between a contacting element 11 and the frame 10, produced for example from plastics material, of the holder frame 1. When the holder frame 1 is placed onto the housing part 3, the locking element 41, in the form of the wire spring, automatically engages with the associated locking opening 303, 304 on the housing part 3, and thus provides locking between the holder frame 1 and the housing part 3.

In the embodiment shown, the locking element 41 in the form of the wire spring is positioned in a clamped manner between the contacting element 11 and an associated end face 101, 102 of the frame 10 of the holder frame 1 by means of connection limbs 415. The locking element 41 is thus held on the frame 10 in a clamped manner and is inherently elastically resilient.

Figure 13A:
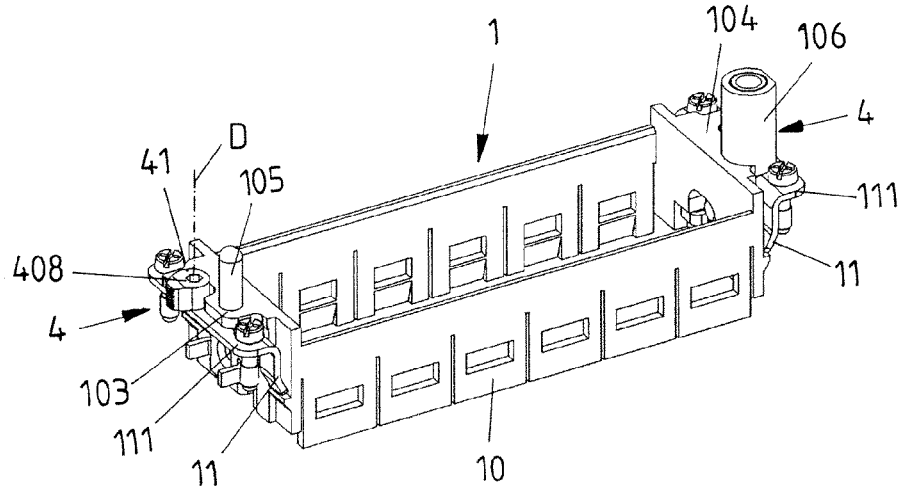
FIG. 13A is a separate view of a further embodiment of a holder frame, with a locking element that is rotatable about a pivoting axis.
Figure 13B:
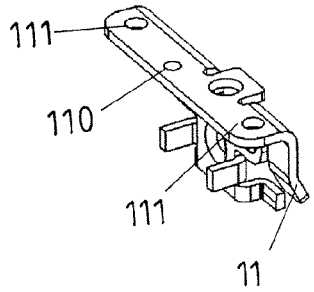
FIG. 13B is a separate view of a contacting element of the holder frame.
Figure 13C:
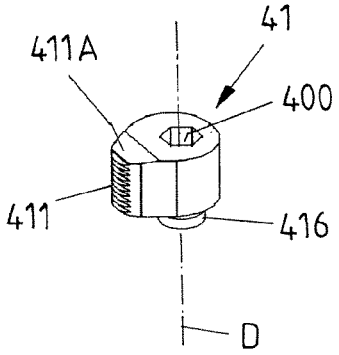
FIG. 13C is a separate view of the locking element that is rotatably arranged on the contacting element.

In the embodiment according to FIG. 13A to 13C, a locking element 41 in the form of a pin that can rotate about an axis of rotation D extending in parallel with the insertion direction E is arranged on a contacting element 11. The locking element 41 comprises a mounting pin 416, by means of which the locking element 41 can be mounted in an associated opening 110 in the contacting element 11 so as to be able to rotate about the axis of rotation D.

The locking element 41 comprises, on an end face facing away from the mounting pin 416, an engagement opening 400 into which a tool, for example in the shape of a hexagon, can engage in order to rotate the locking element 41 between a locked position and an unlocked position.

A locking portion 411 is formed on the locking element 41 so as to project perpendicularly to the axis of rotation D, which portion can engage in an associated locking opening 303, 304 in the housing 3 in order to thus lock the holder frame 1 to the housing part 3. An edge 411A is formed on the upper face of said locking portion 411, by means of which edge the locking element 41, in the locked position, comes to abut the abutment edge 303A of the associated locking opening 303, 304.

In a further embodiment shown in FIG. 14A-14D to 17, locking unit 4 are formed as clamping means for clamping the holder frame 1 with respect to the housing part 3.

Each of the locking unit 4 arranged on the flange portions 103, 104 of the frame 10 of the holder frame 1 comprises a locking element 41 in the form of a U-shaped bracket that includes a base 417 and limbs 418, 419 extending from the base 417. A locking portion 411 in the form of a projecting edge is formed on the base 417, by means of which edge the locking element 41, in the locked position, engages in an associated locking unit 303, 304 of the housing part 3 (see FIGS. 16A and 16B).

A contact element 105, 106 is arranged on each flange portion 103, 104 of the frame 10, as is also the case in the embodiments described above, by means of which element PE contacting with a mating plug-in connector part to be placed onto the plug-in connector part can be provided. The contact element 105, 106, as in FIG. 14B to 14D for the contact element 105 in the form of a contact pin shown on the left in FIG. 14A, engages through an opening 109 in the base 417 of the bracket-shaped locking element 41 and is positioned in an associated opening in the flange portion 103.

A plate element 44 is held between the pin-shaped contact element 105 and a contact block 108 in the region of an annular groove 107 in the contact element 105, which plate element comes to be positioned in the region of the annular groove 107 by means of an opening 441 and secures the locking element 41 to the flange portion 103 on account of the engagement of an opening 442 in the plate element 44 with a slot 443 in the limb 418 of the bracket-shaped locking element 41.

The other limb 419 of the bracket-shaped locking element 41 comes to be positioned in the region of an opening 440 in the plate element 44 and engages through the flange portion 103, said limb 419 being movable relative to the flange portion 103 and the plate element 44, as is intended to be described in the following.

A threaded opening 430 is formed in the base 417 of the locking element 41, in which opening a clamping element 43 in the form of a screw engages. The clamping element 43 engages through the flange portion 103, but is supported on the plate element 44 such that, when the clamping element 43 is screwed into the threaded opening 430 in the base 417 of the bracket-shaped locking element 41, the locking element 41 is clamped with respect to the plate element 44 and thus also with respect to the flange portion 103.

Figure 15A:
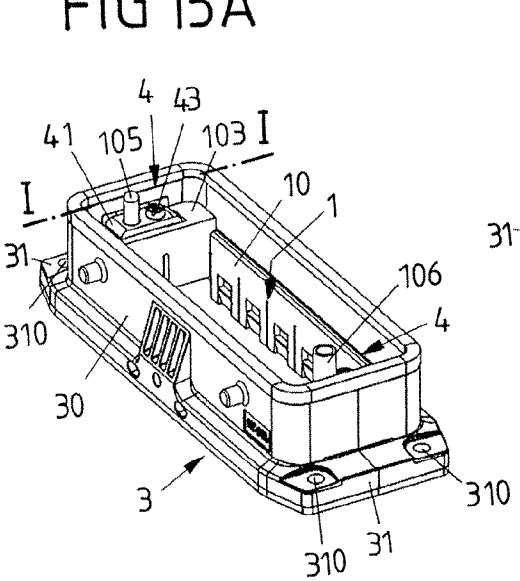
FIG. 15A shows the holder frame inserted into the housing part.
Figure 15B:
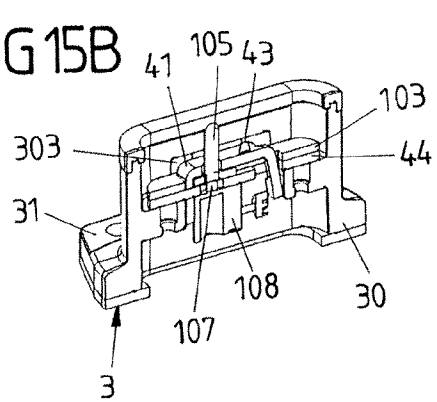
FIG. 15B is a sectional view along the line I-I according to FIG. 15A.

In order to insert the holder frame 1 into the receiving opening 300 in the housing part 3, the locking element 41 is not initially clamped, and is thus brought close to the flange portion 103 by means of its base 417 (see FIGS. 15A and 15B). The locking portion 411 is thus pulled back such that the holder frame 1 can be inserted into the housing part 3 in the insertion direction E.

Figure 16A:
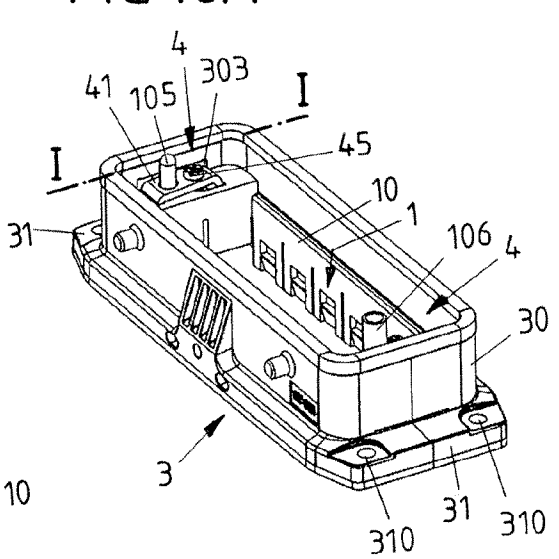
FIG. 16A shows the holder frame inserted into the housing part, with the locking element being clamped.
Figure 16B:
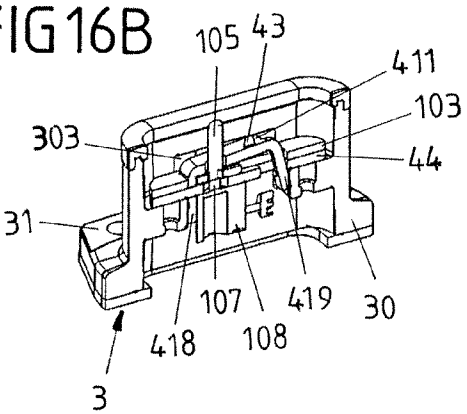
FIG. 16B is a sectional view along the line I-I according to FIG. 16A.

If the holder frame 1 has been inserted into the housing part 3, the bracket-shaped locking element 41 can be clamped by rotating the clamping element 43 in the form of the screw, as shown in FIGS. 16A and 16B. As a result, the locking element 41 is lifted together with the base 417, the limb 418, however, being held in position with respect to the flange portion 103, and the locking element 41 together with the other limb 419 is shifted with respect to the flange portion 103 (see in particular FIG. 16B). As a result, the locking element 41 is (also) pushed outwards and thus comes to engage with the associated locking opening 303 in the end face 301 of the receiving frame 30 of the housing part 3 by means of the locking portion 411 on the base 417.

By clamping the locking element 41, the locking element 41 is thus pressed against the abutment edge 303A of the associated locking opening 303 by means of the locking portion 411 such that the holder frame 1 is clamped to the housing part 3.

Figure 14A:
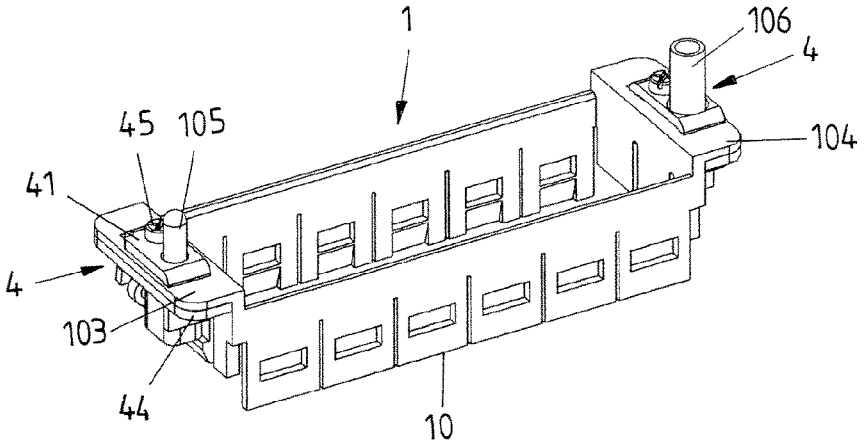
FIG. 14A shows a further embodiment of a holder frame, with a bracket-shaped locking element.
Figure 14B:
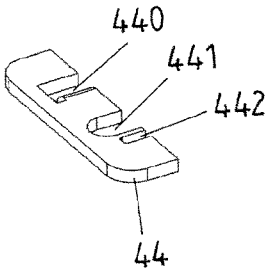
FIG. 14B is a separate view of a frame part of the holder frame.
Figure 14C:
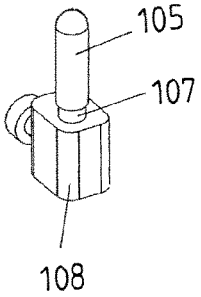
FIG. 14C is a separate view of a contact element to be placed on the holder frame.
Figure 14D:
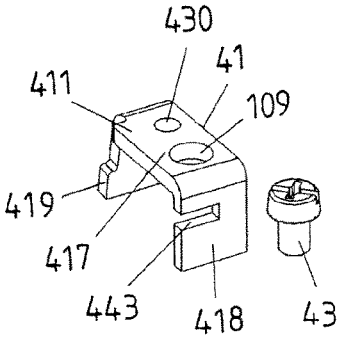
FIG. 14D is a separate view of the bracket-shaped locking element, together with a clamping element in the form of a screw.
Figure 17:
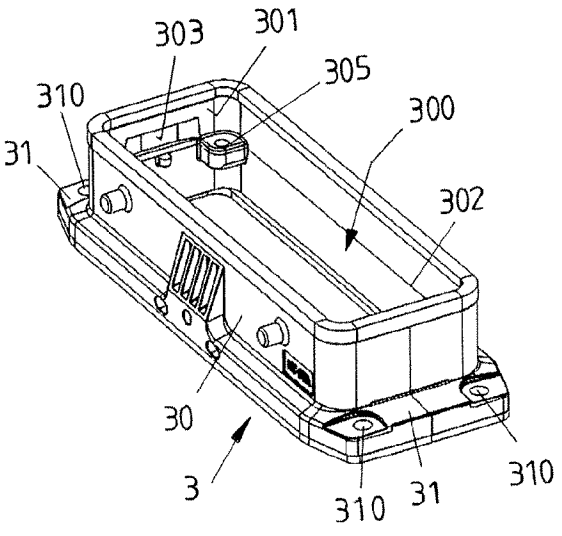
FIG. 17 is a separate view of the housing part.

The above description with respect to the locking unit 4 shown on the left in FIG. 14A also applies analogously to the locking unit 4 on the other, right-hand side of FIG. 14A.

A contacting line may be inserted into the contact block 108 of the contact element 105 and can thus be connected to the contact element 105 in an electrically contacting manner in order to provide for example PE contacting of the holder frame 1.

The basic concept of the invention is not limited to the embodiments described above but can in principle also be implemented by quite different embodiments.

Locking unit can in principle have an entirely different design. Locking is in this case produced by a locking element engaging in an associated locking opening in the housing part, a clamping force preferably being exerted that presses the holder frame into abutment with the housing part in the insertion direction.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE

1 Holder frame
10 Frame
100 Frame opening
101, 102 End face
103, 104 Flange portion
105, 106 Contact element
107 Annular groove
108 Contact block
109 Opening
11 Contacting element
110 Opening
111 Bearing portions
2 Modular contact inserts
20 Contact insert
21 Contact
3 Housing part
30 Receiving frame
300 Receiving opening
301, 302 End face
303, 304 Locking opening (recess)
303A Abutment edge
305 Bearing portion
31 Fastening portion
32 Housing
4 Locking unit
40 Actuating element
400 Engagement opening
401 Handle
402 Mounting portion
403 Opening
404 Slot receptacle
405 Projection
41 Locking element
410 Latching hoop
411 Locking portion
411A Edge
411B End
412 Mounting portion
413 Abutment portion
414 Connection portion

415 Connection limb
416 Mounting pin
417 Base
418, 419 Limb
42 Mounting means
420 Latching portion (latching lug)
421 Mounting pin
422 Bearing portion
43 Clamping element (screw)
430 Threaded opening
44 Plate element
440-442 Opening
443 Slot
5 Tool
E Insertion direction
F Clamping force
S1, S2 Pivoting direction

The invention claimed is:

1. An assembly of a plug-in connector part, comprising:

a holder frame configured to receive at least one modular contact insert, the holder frame enclosing an opening into which at least one contact insert can be inserted; and a housing part comprising a receiving opening into which the holder frame is configured to be inserted in an insertion direction, and a bearing portion on which the holder frame rests in a position in which the holder frame is inserted into the receiving opening, wherein the housing part comprises a locking opening and the holder frame comprises a locking unit configured to lock the holder frame to the housing part in the inserted position, the locking unit comprising a locking element which, in a locked position, is configured to form-fittingly engage in the locking opening in the housing part, wherein the locking element is connected to an actuating element and is configured to be shifted between an unlocked position and the locked position by the actuating element, and wherein the locking between the holder frame and the housing part is detachable.

2. The assembly according to claim 1, wherein the locking element is configured, by engaging in the locking opening in the housing part in the locked position, to exert a clamping force on the holder frame in the insertion direction in order to press the holder frame into abutment with the bearing portion in the insertion direction.

3. The assembly according to claim 1, wherein the holder frame electrically contacts the bearing portion in the inserted position.

4. The assembly according to claim 1, wherein the holder frame rests on the bearing portion by way of a flange portion in the inserted position.

5. The assembly according to claim 1, wherein a contact element is arranged on the flange portion for electrically contacting an associated mating contact element of a mating plug-in connector part that can be placed onto the plug-in connector part.

6. The assembly according to claim 1, wherein the actuating element comprises an engagement opening configured to allow engagement by a tool.

7. The assembly according to claim 1, wherein the locking element comprises a locking portion having an edge that extends perpendicularly to the insertion direction, the edge being positioned in the locking opening in the locked position of the locking element and abutting an abutment edge that defines the engagement opening counter to the insertion direction.

8. The assembly according to claim 1, wherein the locking element is arranged on a frame part of the holder frame so as to be pivotable about a mounting pin extending perpendicularly to the insertion direction.

9. The assembly according to claim 8, wherein the holder frame comprises a latching portion configured to latch with the locking element in the locked position and to which the locking element is thus form-fittingly held in the locked position.

10. The assembly according to claim 1, wherein the locking element is integral with a frame part of the holder frame.

11. The assembly according to claim 1, wherein the locking element is connected to a contacting element arranged on a frame part of the holder frame for electrically contacting the bearing portion of the housing part.

12. The assembly according to claim 1, wherein the locking element comprises a wire spring and is connected to a contacting element arranged on a frame part of the holder frame for electrically contacting the bearing portion of the housing part.

13. The assembly according to claim 1, wherein the locking element is configured to be rotated about an axis of rotation that is oriented longitudinally in the insertion direction.

14. The assembly according to claim 1, wherein the locking element comprises a bracket that is movably arranged on a frame part of the holder frame, engages with a clamping element, and is configured be clamped with respect to the frame part by way of the clamping element such that the locking element, in the locked position, is positioned in the locking opening in the housing part under preloading.

15. The assembly according to claim 14, wherein the clamping element comprises a screw and is in threaded engagement with a threaded opening in the locking element.

16. The assembly according to claim 14, wherein the clamping element is configured, in a clamped state, to press the locking element into abutment with the housing part in the insertion direction.

* * * * *